US006938558B1

(12) United States Patent
Peres

(10) Patent No.: US 6,938,558 B1
(45) Date of Patent: Sep. 6, 2005

(54) PLASTIC PALLET

(76) Inventor: Victor L Peres, 7440 Millfair Rd., McKane, PA (US) 16426

( * ) Notice: Subject to any disclaimer, the term of this patent is extended or adjusted under 35 U.S.C. 154(b) by 0 days.

(21) Appl. No.: 10/414,635

(22) Filed: Apr. 16, 2003

(51) Int. Cl.[7] ..... B65D 19/00

(52) U.S. Cl. ..... 108/56.3; 108/58.19; 108/57.25; 108/901

(58) Field of Search ..... 108/56.1, 56.3, 108/57.25, 57.17, 57.18, 57.19, 901

(56) References Cited

U.S. PATENT DOCUMENTS 2,371,106 A * 3/1945 Lewis et al. ..... 108/57.1
3,878,796 A * 4/1975 Morrison ..... 108/56.1
4,198,034 A * 4/1980 Svirklys ..... 256/72
4,485,744 A * 12/1984 Umemura et al. ..... 108/57.18
5,101,737 A * 4/1992 Gomez ..... 108/57.18
5,417,167 A * 5/1995 Sadr ..... 108/57.19
5,440,998 A * 8/1995 Morgan et al. ..... 108/57.18
5,662,048 A * 9/1997 Kralj et al. ..... 108/56.3
5,941,179 A * 8/1999 Herring ..... 108/56.3
6,766,749 B2 * 7/2004 Lacabanne ..... 108/56.3

FOREIGN PATENT DOCUMENTS

GB 2340818 * 3/2000
JP 403256846 * 11/1991 ..... 108/56.1

* cited by examiner

*Primary Examiner*—Lanna Mai
*Assistant Examiner*—Hanh V. Tran
(74) *Attorney, Agent, or Firm*—Richard K Thomson

(57) ABSTRACT

A two-part, blow-molded plastic pallet includes slats which lock onto support stringers by sliding, dovetail engagement. The upper and lower surfaces of the stringer are flat to enhance load distribution. A vertical staking through the slat at a plurality of locations affords structural rigidity.

9 Claims, 5 Drawing Sheets

32
40
42
34
36
38
46
48
$W_3$
$W_1$ $l_1$
44
33
35
34
B
A
31
47
$h_2$

45
$h_1$
$t_1$
$W_2$

PLASTIC PALLET

BACKGROUND AND SUMMARY OF THE INVENTION

The present invention is directed to the field of pallets for storing/transporting goods. More particularly, the present invention is directed to a plastic pallet with snap together components.

Pallets are typically formed of wood. The components, the stringers and the slats, are held together by nails. These pallets afford a number of problems for handlers. First, the wood has limited strength and is subject to breaking. Even if the boards remain intact, they can create splinters. Further, where pallets are used to store food goods, cleanliness is important. However, wood does not wash off well and the exposure of the nails to water produces rust, eventually leading to the pallets coming apart. Splinters, broken jagged slats, unstable pallets, and rusty nails all contribute to a hazardous work zone for those responsible for manipulating the pallets and their stored goods. Further, the residual food particles trapped in the interstices of the wood, form breeding grounds for health problems, attract rats and, if nothing else, produce a stench as the food rots.

As a result, attempts have been made to make plastic pallets. Plastic is a durable material that washes easily and can, if formed properly, provide the necessary strength needed in pallet performance. The components of the plastic pallet of the present invention have been engineered to fasten together quickly and easily and to stay together permanently.

The plastic pallet of the present invention comprises a first plurality of stringers having a first maximum height, a first maximum width, and first length extending parallel to each other in a first direction, each of the plurality of stringers having a flat uppermost surface, and a flat lowermost surface. The flat uppermost surface has a central region which extends to the first maximum height over an entirety of the first length. The stringer has a second plurality of attachment regions each for receiving a slat. The pallet includes a third plurality of slats, the third plurality being equal to the second plurality of attachment regions, each slat having a first plurality of dovetail slots for receiving and locking to the attachment regions the first plurality of stringers.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
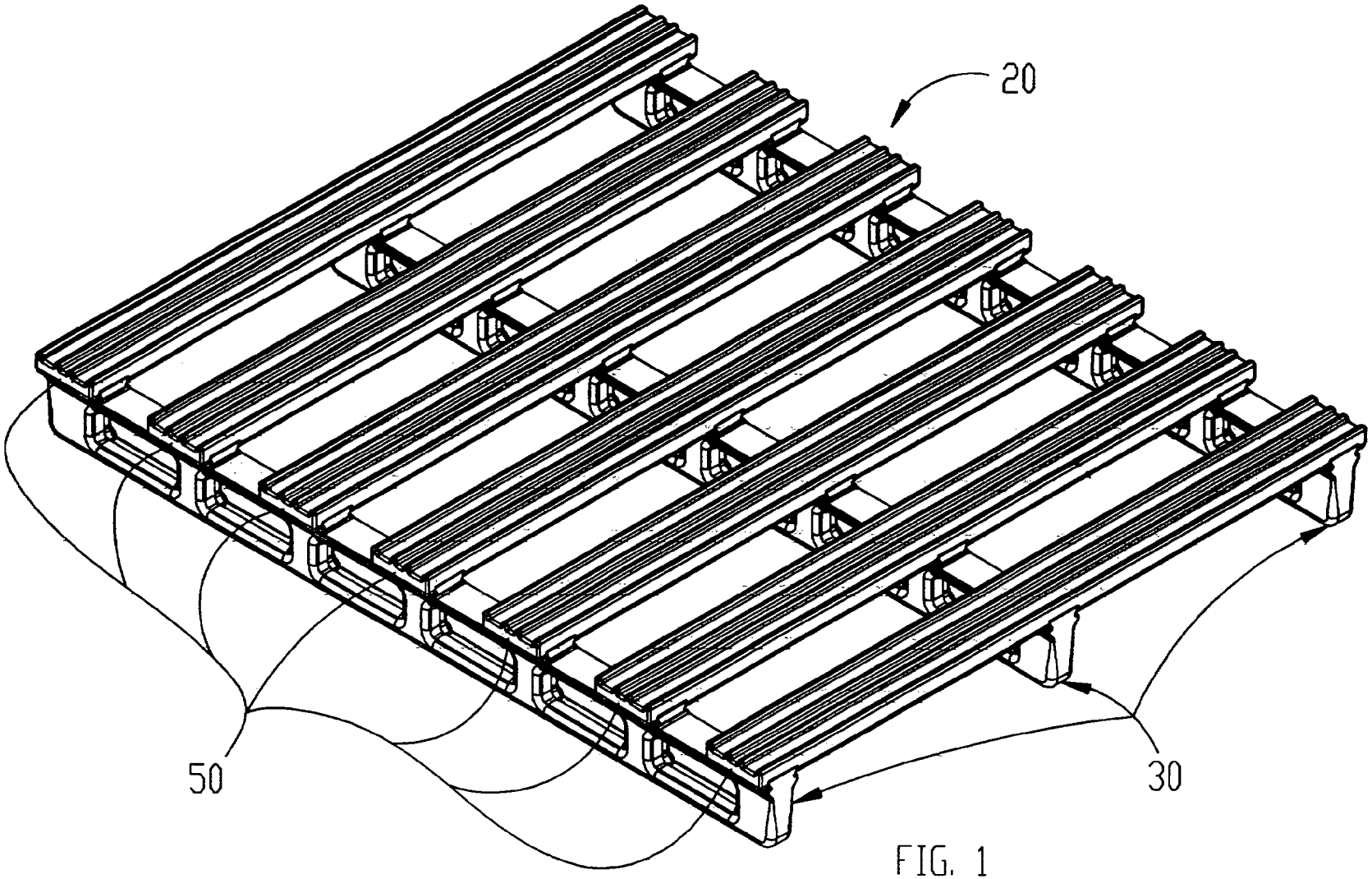
FIG. 1 is a perspective view of a first embodiment of the plastic pallet of the present invention.
Figures 2, 3, 4A, 4B:
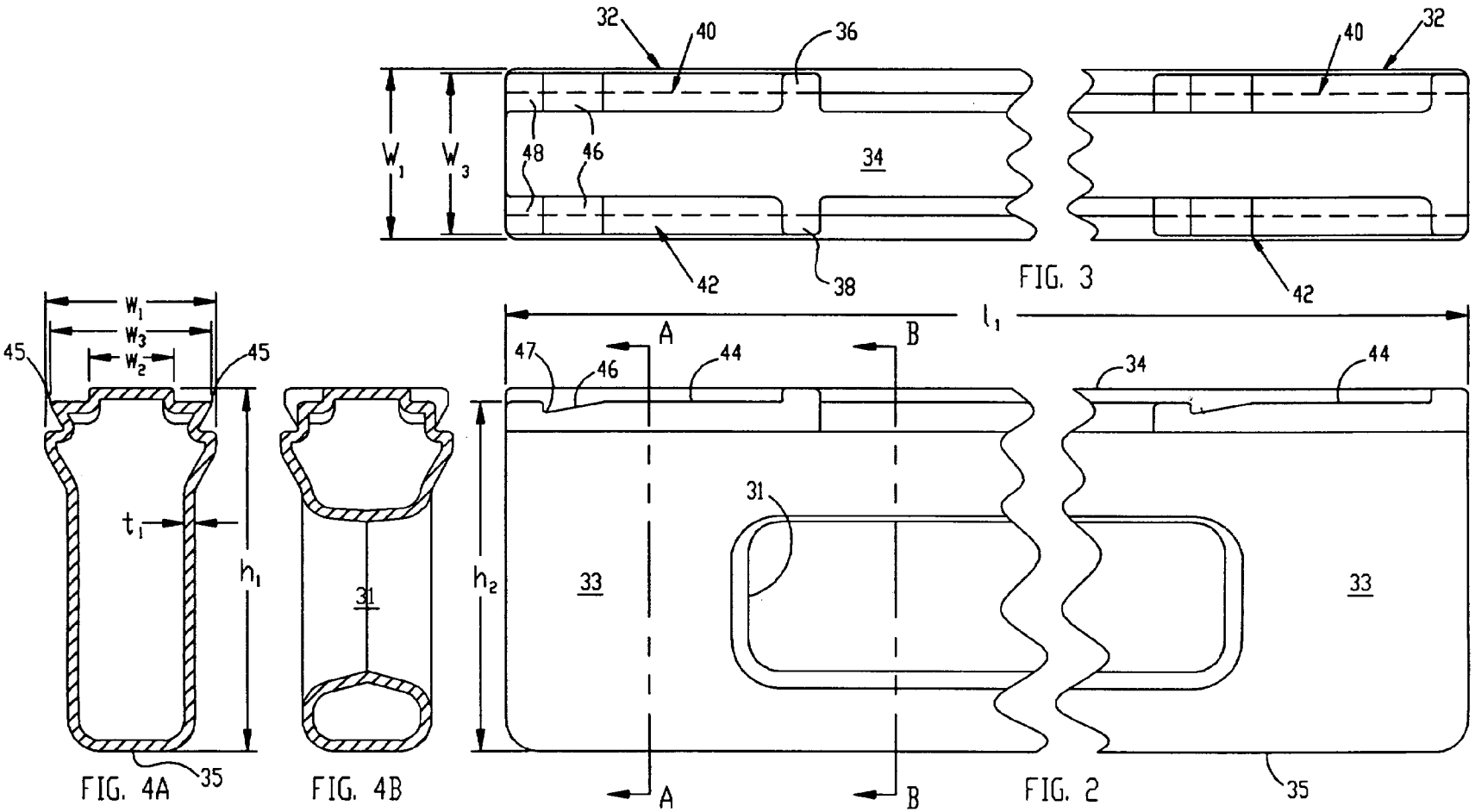
FIG. 2 is a side view a first embodiment of the stringer used in the plastic pallet of the present invention.
FIG. 3 is a top view of the first embodiment of the stringer.
FIG. 4A is a first cross-sectional end view of a first embodiment of the stringer as seen along line 4A—4A.
FIG. 4B is a second cross-sectional end view of a first embodiment of the stringer as seen along line 4B—4B.
Figure 5:
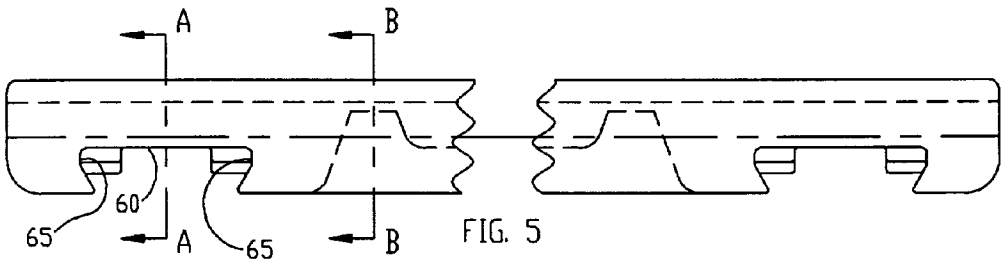
FIG. 5 is a side view of a first embodment of the slat used in the plastic pallet of the present invention.
Figure 6:
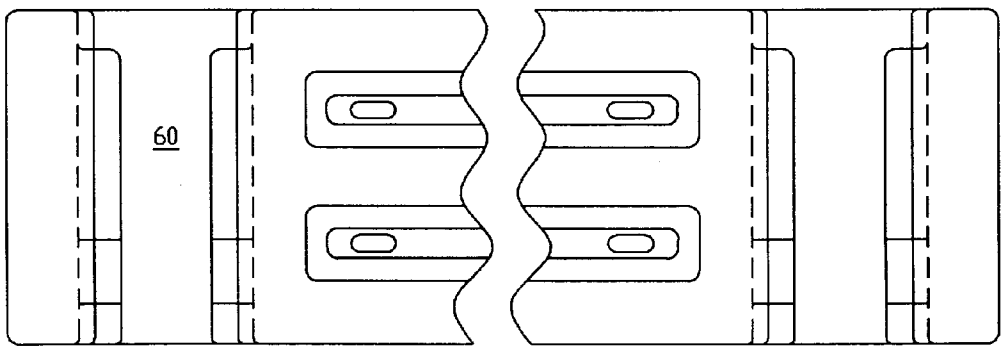
FIG. 6 is a bottom view of the slat used in the plastic pallet of the present invention.

A first embodiment of the plastic pallet of the present invention is shown in FIG. 1 generally at 20. As depicted in that view, plastic pallet 20 is comprised of a first plurality (as depicted in FIG. 1, three) stringers 30 having a first maximum height ha (see FIG. 4A), a first maximum width $w_1$ and an overall length $\mathbf{1}_1$, (FIG. 2) extending generally parallel to one another. Supported by and attached to the plurality of stringers 30 at each of a second plurality of attachment regions 32 (FIG. 3) is one of a third plurality of slats 50. Stringers 30 are hollow being formed of polyethylene using a blow molded process and have a generally uniform wall thickness $t_1$, with a plurality of apertures 31 inter-spaced with columns 33 (FIG. 2). Columns 33 provide structural support while apertures 31 reduce the amount of material needed to form the part.

As seen in more detail in FIGS. 2, 3, 4A, 4B stringer 30 has a first flat, central uppermost surface 34 which has a width $w_2$ which is generally about ½ of the maximum width $w_1$ of the stringer 30 and a second flat, central lowermost surface 35. The two central flat surfaces 34, 35 extend the entire length $\mathbf{1}_1$ of the stringer and are provided to better distribute the load over the entire stringer 30. The second plurality of attachment regions 32 each have a configuration which includes two portions 36 and 38 extending laterally outwardly from the central uppermost portion 32 defining a third width $w_3$ at the maximum height $h_1$. Two lateral regions 40, 42 of reduced height $h_2$ extend laterally along side the central uppermost portion 32. Each lateral region 40, 42 has a first flat zone 44 of a second height $h_2$, a second downwardly sloping zone 46 which defines a notch 47 and a third flat zone 48 of said second height $h_2$. First flat zone 44 defines a pair of ears 45 that project outwardly to width $w_3$.

Slat 50 of the pallet 20 has a plurality of spaced ribs 52 across its upper surface 54. Ribs 52 both provide structural reinforcement to slat 50 and reduce surface contact with the palletized load. Slats 50 are formed by blow molding and are hollowed out to conserve material. The lower surface 56 of slat 50 has a plurality of staked columns 58, points at which the thickness of material defining lower surface 56 is pushed up into engagement with, and welded to, the thickness of material defining upper surface 54 (see FIG. 7B).

Figure 7A:
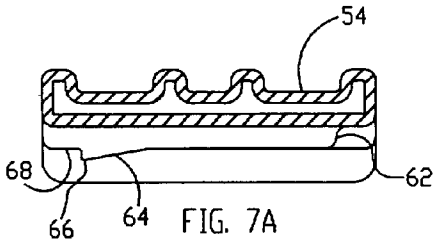
FIG. 7A is a cross-sectional end view as seen along line 7A—7A in FIG. 5.
Figure 8:
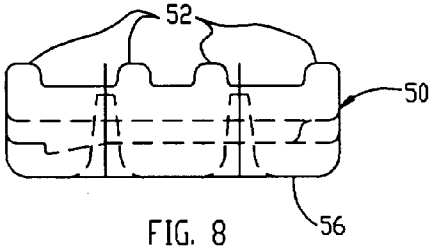
FIG. 8 an end view of the slat used in the plastic pallet of the present invention.
Figure 7B:
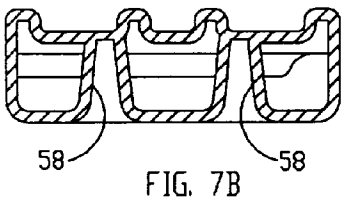
FIG. 7B is a cross-sectional end view as seen along line 7B—7B in FIG. 5.

Each slat 50 has a fourth plurality of dovetail slots 60, the fourth plurality being equal in number to the first plurality of stringers 22 to which they are attached. Each dovetail slot has a second configuration which is complementary to the first configuration formed on the attachment regions 32. As best seen in FIG. 7A, second configuration includes a recess 62 that receives the two portions 36 and 38 and locks the slat 50 against sliding toward the right as shown in FIG. 2. A downwardly sloping portion 64 forms protrusion 66 that is received in notch 47 preventing the slat's removal once it is slid on from left to right (FIG. 2) locking it onto the stringer. Slat 50 can only be assembled onto stringers 30 from left to right, as seen in FIG. 2. Flat surface 68 sits atop flat surface 48 of attachment region 32. Recesses 65 receive ears 45 and prevent slat 30 from being lifted up.

Figure 9:
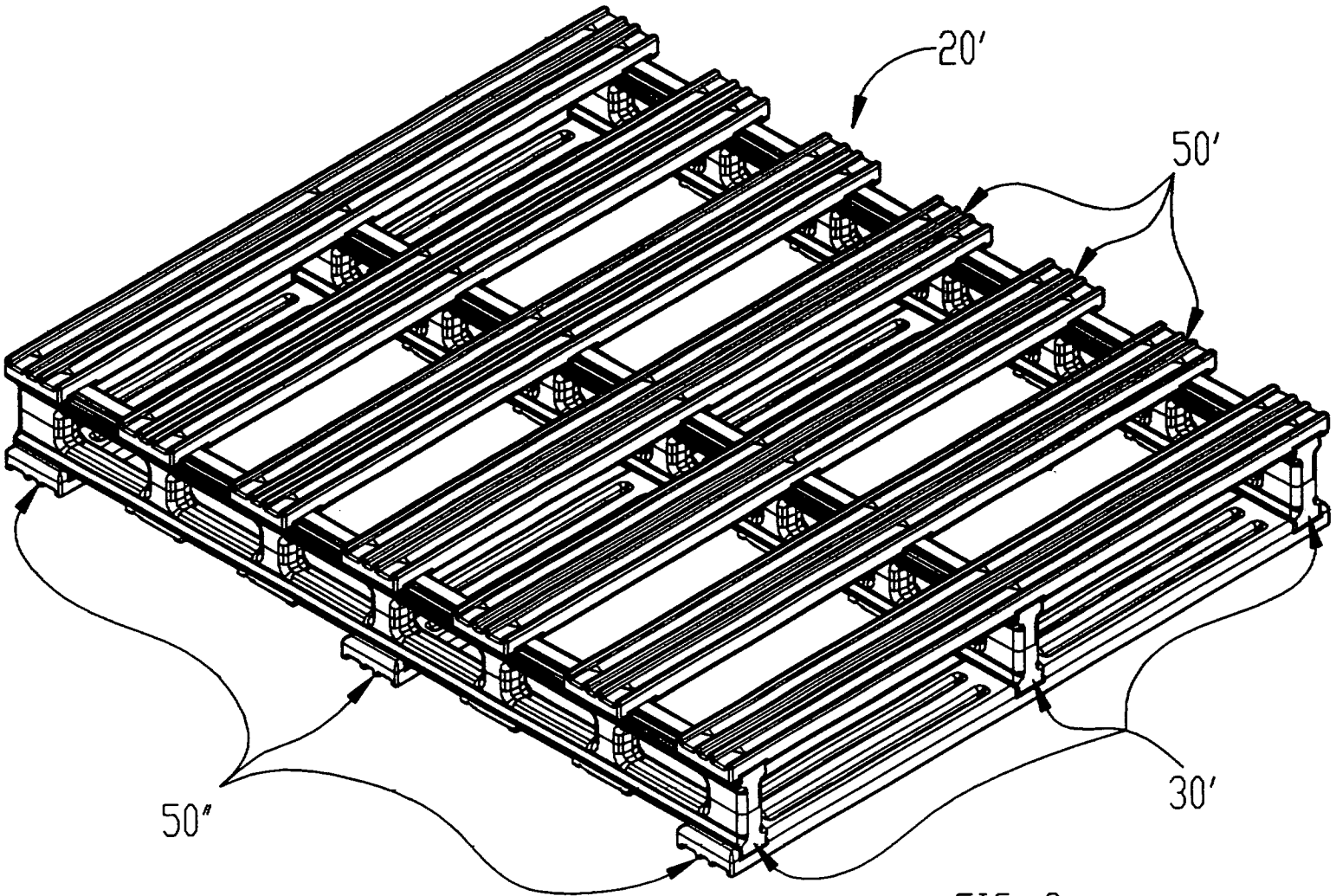
FIG. 9 is a perspective view of a second embodiment of the plastic pallet.
Figure 10:
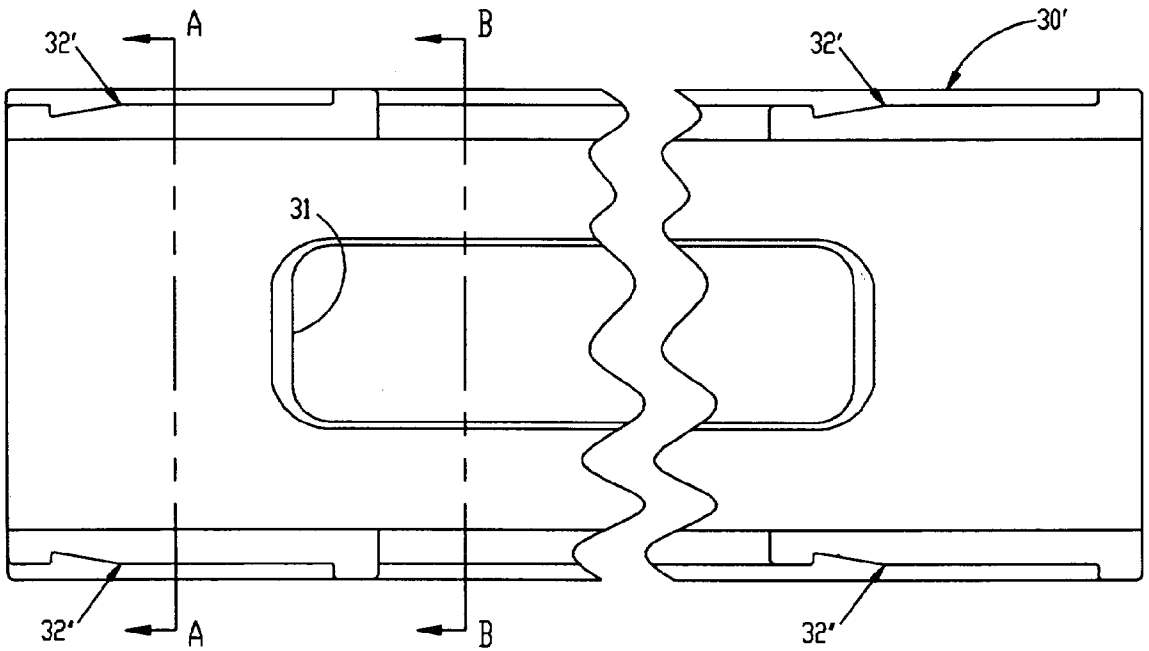
FIG. 10 is a side view of the second embodiment.
Figure 11B:
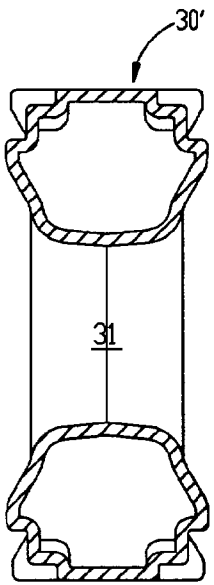
FIG. 11B is a second cross-sectional end view of a first embodiment of the stringer as seen along line 11B—11B.
Figure 11A:
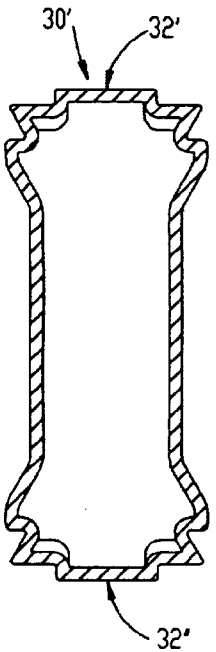
FIG. 11A is a first cross-sectional end view of the second embodiment of the stringer as seen along line 11A—11A.

A second embodiment of plastic pallet of the present invention is shown in FIG. 9 generally at 20'. In this embodiment, the attachment regions 32' on the top of stringer 30' is duplicated on the bottom at 32" (FIGS. 10, 11A, 11B). Typically a fewer number of slats 50" will be attached to the attachment regions 32" than slats 50' attached to regions 32'. These slats will provide increased structural rigidity and, when the pallet 20' is engaged from the ends (rather than through the holes 31'), these bottom slats will prevent the pallet from falling off the forklift due to tilting of the load as a result of, for example, the operator turning a sharp corner or stopping abruptly such that momentum of the load produces a torquing of the pallet stack.

Various changes, alternatives and modifications will become apparent to one of ordinary skill in the art following a reading of the foregoing specification. For example, the stringer 50 of the present invention is shown as having 7 attachment regions 32. Obviously, the stringer 30 could be designed to have more or less attachment regions. Preferably, additional attachment regions would be provided, such as nine, for example, with slats being omitted for applications where the size of the load would permit fewer slats to be provided. It is intended that any such changes, alternatives and modifications as fall within the scope of the appended claims be considered part of the present invention.

I claim:

1. A plastic pallet comprising a. a plurality of stringers having a maximum height, a first maximum width, and first overall length extending parallel to each other in a first direction, each of said plurality of stringers having i) a totally flat uppermost surface and ii) a flat lowermost surface, iii) said totally flat uppermost surface having a central region which extends to said maximum height over an entirety of said first length, iv) a plurality of attachment regions each for receiving a slat;

b. a plurality of slats, said plurality of slats being equal to said plurality of attachment regions, each said slat having a plurality of dovetail slots for receiving and locking to said attachment regions of said plurality of stringers, wherein said attachment regions of said stringers have a first configuration and comprise portions extending laterally outwardly from said central region defining a second width at said maximum height and lateral regions of reduced height at said second width extending along each side of said central region.

2. The plastic pallet of claim 1 wherein said flat uppermost surface of said central region of said stringer extends a third width which is generally about ½ of said maximum width throughout said first length of said stringer.

3. The plastic pallet of claim 1 wherein said lateral regions of a reduced height comprise a first flat zone of a second height, a second downwardly sloping zone which defines a notch and a third flat zone of said second height.

4. The plastic pallet of claim 3 wherein an inner surface of said dovetail slot in said slat comprises a second configuration which complements said first configuration in said attachment region of said stringer.

5. The plastic pallet of claim 3 wherein said flat lowermost surface comprises a third configuration substantially identical to said first configuration with a plurality of attachment regions.

6. The plastic pallet of claim 5 further comprising a plurality of slats attached to said plurality of attachmentregions of said flat lowermost surface, said plurality being less than said fifth plurality of said attachment regions.

7. The plastic pallet of claim 1 wherein each said slat can only be assembled by sliding said dovetail slot onto said attachment region in a first axial direction and, once assembled, said slat is locked onto said plurality of stringers.

8. The plastic pallet of claim 1 wherein said stringers and said slats are each hollow.

9. The plastic pallet of claim 8 wherein at least one of said slats are reinforced with ribs and staked columns.

* * * * *